US010324404B2

(12) United States Patent
Akiyama et al.

(10) Patent No.: US 10,324,404 B2
(45) Date of Patent: Jun. 18, 2019

(54) BELT DEVICE INCLUDING A COATED DRIVING ROTATOR, TRANSFER DEVICE, AND IMAGE FORMING APPARATUS

(71) Applicants: Takuya Akiyama, Kanagawa (JP); Takeshi Sakashita, Tokyo (JP); Yuuji Meguro, Kanagawa (JP)

(72) Inventors: Takuya Akiyama, Kanagawa (JP); Takeshi Sakashita, Tokyo (JP); Yuuji Meguro, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 25 days.

(21) Appl. No.: 15/662,471

(22) Filed: Jul. 28, 2017

(65) Prior Publication Data

US 2018/0059595 A1 Mar. 1, 2018

(30) Foreign Application Priority Data

Aug. 29, 2016 (JP) ..... 2016-166717

(51) Int. Cl.
*G03G 15/20* (2006.01)
*G03G 15/16* (2006.01)

(52) U.S. Cl.
CPC ..... *G03G 15/2057* (2013.01); *G03G 15/1615* (2013.01); *G03G 15/2025* (2013.01); *G03G 15/2028* (2013.01); *G03G 2215/2035* (2013.01); *G03G 2215/2041* (2013.01)

(58) Field of Classification Search
None
See application file for complete search history.

(56) References Cited

U.S. PATENT DOCUMENTS

| | | | | |
|---|---|---|---|---|
| 9,665,046 | B2 * | 5/2017 | Aoto | G03G 15/1615 |
| 2003/0087097 | A1 * | 5/2003 | Lukschandel | C23C 28/021 428/408 |
| 2004/0234301 | A1 * | 11/2004 | Sato | G03G 21/206 399/299 |
| 2005/0214036 | A1 * | 9/2005 | Embry | G03G 15/1685 399/302 |
| 2007/0183816 | A1 | 8/2007 | Hatayama et al. | |
| 2008/0003022 | A1 | 1/2008 | Sakashita et al. | |
| 2012/0301191 | A1 * | 11/2012 | Ito | G03G 15/162 399/302 |
| 2013/0011158 | A1 | 1/2013 | Meguro et al. | |
| 2015/0177653 | A1 * | 6/2015 | Seki | G03G 15/162 399/101 |
| 2017/0097589 | A1 | 4/2017 | Seki et al. | |
| 2017/0139353 | A1 | 5/2017 | Sakashita et al. | |

FOREIGN PATENT DOCUMENTS

| | | |
|---|---|---|
| JP | 5-338825 | 12/1993 |
| JP | 11-310349 | 11/1999 |
| JP | 2001-072274 | 3/2001 |
| JP | 2001-209258 | 8/2001 |
| JP | 2010-054848 | 3/2010 |

* cited by examiner

*Primary Examiner* — Clayton E. LaBalle
*Assistant Examiner* — Leon W Rhodes, Jr.
(74) *Attorney, Agent, or Firm* — Oblon, McClelland, Maier & Neustadt, L.L.P.

(57) ABSTRACT

A belt device includes a belt that is rotatable and a driving rotator to drive and rotate the belt and to be accidentally adhered with a foreign substance. The driving rotator includes a coating layer as a surface layer. The coating layer includes a plurality of fine particles.

20 Claims, 9 Drawing Sheets

FIG. 4

| WITH OR WITHOUT FINE PARTICLES | DISPLACEMENT |
|---|---|
| WITH FINE PARTICLES | NO |
| WITHOUT FINE PARTICLES | YES |

FIG. 5

| AVERAGE PARTICLE DIAMETER | CLEANING FAILURE |
|---|---|
| X > PARTICLE DIAMETER ≥ X/2 | NO |
| X/2 > PARTICLE DIAMETER > 0 | YES |

FIG. 6

| MATERIAL | CLEANING FAILURE |
|---|---|
| RUBBER | NO |
| METAL | YES |

FIG. 7

CONDITION A

| AVERAGE PARTICLE DIAMETER (μm) | | | | | |
|---|---|---|---|---|---|
| 120 | YES | YES | YES | YES | NO |
| 100 | YES | YES | YES | NO | NO |
| 80 | YES | YES | NO | NO | NO |
| 60 | YES | NO | NO | NO | NO |
| 40 | NO | NO | NO | NO | NO |
| 20 | NO | NO | NO | NO | NO |
| 10 | NO | NO | NO | NO | NO |
| | 0.75 | 0.8 | 0.85 | 0.9 | 0.95 |
| | CIRCULARITY | | | | |

FIG. 8

CONDITION B

| AVERAGE PARTICLE DIAMETER (μm) | | | | | |
|---|---|---|---|---|---|
| 120 | YES | YES | YES | YES | YES |
| 100 | YES | YES | YES | YES | YES |
| 80 | YES | YES | YES | NO | NO |
| 60 | YES | YES | YES | NO | NO |
| 40 | YES | NO | NO | NO | NO |
| 20 | NO | NO | NO | NO | NO |
| 10 | NO | NO | NO | NO | NO |
| | 0.75 | 0.8 | 0.85 | 0.9 | 0.95 |
| | CIRCULARITY | | | | |

FIG. 9

CONDITION C

| | | | | | | |
|---|---|---|---|---|---|---|
| AVERAGE PARTICLE DIAMETER (μm) | 120 | YES | YES | YES | YES | YES |
| | 100 | YES | YES | YES | YES | NO |
| | 80 | YES | YES | YES | NO | NO |
| | 60 | YES | YES | YES | NO | NO |
| | 40 | YES | NO | NO | NO | NO |
| | 20 | YES | NO | NO | NO | NO |
| | 10 | NO | NO | NO | NO | NO |
| | | 0.75 | 0.8 | 0.85 | 0.9 | 0.95 |
| | | CIRCULARITY | | | | |

FIG. 10

CONDITION D

| | | | | | | |
|---|---|---|---|---|---|---|
| AVERAGE PARTICLE DIAMETER (μm) | 120 | YES | YES | YES | YES | YES |
| | 100 | YES | YES | YES | YES | YES |
| | 80 | YES | YES | YES | YES | YES |
| | 60 | YES | YES | YES | YES | YES |
| | 40 | YES | YES | YES | NO | NO |
| | 20 | YES | YES | NO | NO | NO |
| | 10 | YES | NO | NO | NO | NO |
| | | 0.75 | 0.8 | 0.85 | 0.9 | 0.95 |
| | | CIRCULARITY | | | | |

FIG. 11
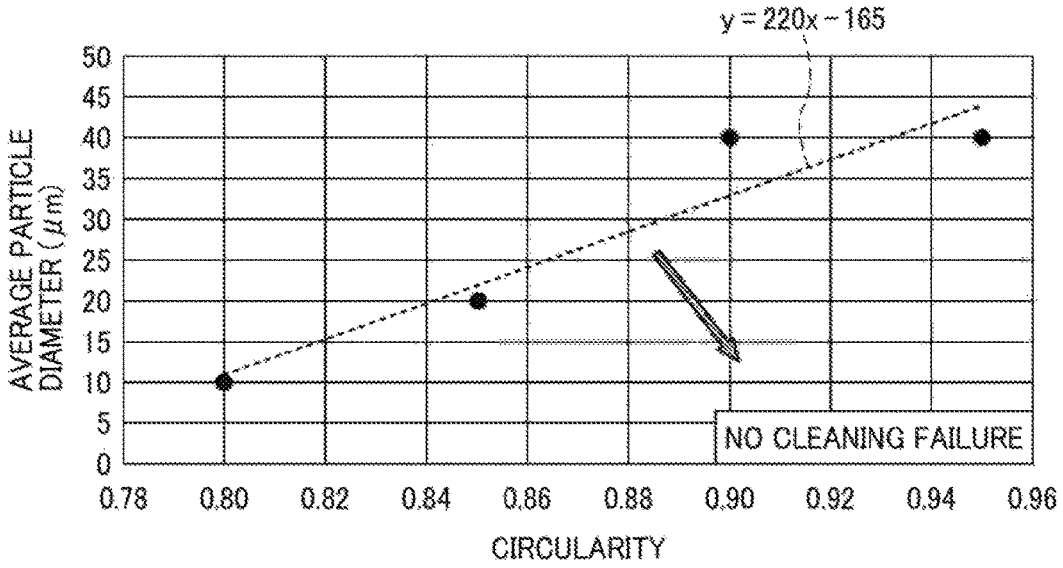
FIG. 12
| WITH OR WITHOUT SCRAPER | CLEANING FAILURE |
|---|---|
| WITH SCRAPER | NO |
| WITHOUT SCRAPER | YES |
FIG. 13
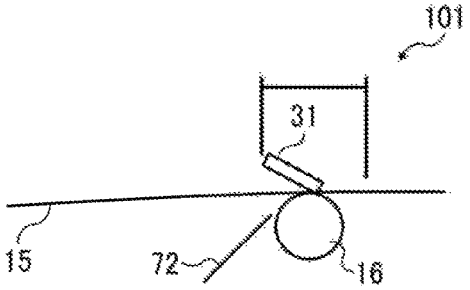

FIG. 14

CONDITION E

| | | | | | | |
|---|---|---|---|---|---|---|
| AVERAGE PARTICLE DIAMETER (μm) | 120 | YES | YES | YES | YES | YES |
| | 100 | YES | YES | YES | YES | YES |
| | 80 | YES | YES | YES | YES | NO |
| | 60 | YES | YES | NO | NO | NO |
| | 40 | YES | NO | NO | NO | NO |
| | 20 | NO | NO | NO | NO | NO |
| | 10 | NO | NO | NO | NO | NO |
| | | 0.75 | 0.8 | 0.85 | 0.9 | 0.95 |
| | | CIRCULARITY | | | | |

FIG. 15

CONDITION F

| | | | | | | |
|---|---|---|---|---|---|---|
| AVERAGE PARTICLE DIAMETER (μm) | 120 | YES | YES | YES | YES | YES |
| | 100 | YES | YES | YES | YES | YES |
| | 80 | YES | YES | YES | YES | YES |
| | 60 | YES | YES | YES | YES | NO |
| | 40 | YES | YES | YES | NO | NO |
| | 20 | YES | YES | NO | NO | NO |
| | 10 | YES | NO | NO | NO | NO |
| | | 0.75 | 0.8 | 0.85 | 0.9 | 0.95 |
| | | CIRCULARITY | | | | |

FIG. 16

CONDITION G

| | | | | | | |
|---|---|---|---|---|---|---|
| AVERAGE PARTICLE DIAMETER (μm) | 120 | YES | YES | YES | YES | YES |
| | 100 | YES | YES | YES | YES | YES |
| | 80 | YES | YES | YES | YES | YES |
| | 60 | YES | YES | YES | YES | NO |
| | 40 | YES | YES | YES | NO | NO |
| | 20 | YES | YES | NO | NO | NO |
| | 10 | YES | YES | NO | NO | NO |
| | | 0.75 | 0.8 | 0.85 | 0.9 | 0.95 |
| | | CIRCULARITY | | | | |

FIG. 17

CONDITION H

| | | | | | | |
|---|---|---|---|---|---|---|
| AVERAGE PARTICLE DIAMETER (μm) | 120 | YES | YES | YES | YES | YES |
| | 100 | YES | YES | YES | YES | YES |
| | 80 | YES | YES | YES | YES | YES |
| | 60 | YES | YES | YES | YES | YES |
| | 40 | YES | YES | YES | YES | NO |
| | 20 | YES | YES | YES | NO | NO |
| | 10 | YES | YES | NO | NO | NO |
| | | 0.75 | 0.8 | 0.85 | 0.9 | 0.95 |
| | | CIRCULARITY | | | | |

BELT DEVICE INCLUDING A COATED DRIVING ROTATOR, TRANSFER DEVICE, AND IMAGE FORMING APPARATUS

CROSS-REFERENCE TO RELATED APPLICATION

This patent application is based on and claims priority pursuant to 35 U.S.C. § 119 to Japanese Patent Application No. 2016-166717, filed on Aug. 29, 2016, in the Japanese Patent Office, the entire disclosure of which is hereby incorporated by reference herein.

BACKGROUND

Technical Field

Embodiments generally relate to a belt device, a transfer device, and an image forming apparatus, and more particularly, to a belt device incorporating a belt, a transfer device for transferring an image., and an image forming apparatus for forming an image on a recording medium.

Background Art

Related-art image forming apparatuses, such as copiers, facsimile machines, printers, and multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via art intermediate transfer belt finally, a fixing device applies heat and pressure to the recording medium bearing the toner image to fix the toner image on the recording medium, thus forming the image on the recording medium.

Such image forming apparatuses that form a toner image by electrophotography are not only used in offices but also used in home offices and by general users. In order to address usage in the home offices and by the general users, the image forming apparatuses are requested to form the toner image on transfer sheets of various types. To address this request, the image forming apparatuses may employ art intermediate transfer method. For example, after a toner image formed on the photoconductor is primarily transferred onto the intermediate transfer belt, a secondary transfer roller secondarily transfers the toner image from the intermediate transfer belt onto a transfer sheet.

In the intermediate transfer method, a coefficient of friction and an electric resistance of a driving roller that drives the intermediate transfer belt are adjusted. The coefficient of friction is adjusted to rotate the intermediate transfer belt precisely. If the coefficient of friction decreases, the driving roller idles and does not rotate the intermediate transfer belt. Conversely, even if the coefficient of friction increases, when a foreign substance such as toner adheres to a surface of the driving roller, the coefficient of friction of the driving roller decreases substantially.

The electric resistance is adjusted to enhance transfer performance to transfer the toner image from the intermediate transfer belt onto the transfer sheet.

SUMMARY

This specification describes below an improved belt device. In one embodiment, the belt device includes a belt that is rotatable and a driving rotator to drive and rotate the belt and to be accidentally adhered with a foreign substance. The driving rotator includes a coating layer as a surface layer. The coating layer includes a plurality of fine particles.

This specification further describes an improved transfer device. In one embodiment, the transfer device includes a belt that is rotatable and a transferor, disposed opposite the belt, to transfer a toner image. A driving rotator drives and rotates the belt and is to be accidentally adhered with toner. The driving rotator includes a coating layer as a surface layer. The coating layer includes a plurality of fine particles.

This specification further describes an improved image forming apparatus. In one embodiment, the image forming apparatus includes a photoconductor to bear a toner image and a transfer device to transfer the toner image. The transfer device includes a belt that is rotatable and a transferor, disposed opposite the belt, to transfer the toner image. A driving rotator drives and rotates the belt and is to be accidentally adhered with toner. The driving rotator includes a coating layer as a surface layer. The coating layer includes a plurality of fine particles.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 4 is a lookup table illustrating a comparison relating to occurrence of displacement of toner images formed on an intermediate transfer belt incorporated in the transfer device depicted in FIG. 1;

FIG. 5 is a lookup table illustrating a first example and a second example of occurrence of cleaning failure according to change in the average particle diameter of the fine particle contained in the coating layer of the driving roller depicted in FIG. 3;

FIG. 6 is a lookup table illustrating a third example of a comparison relating to occurrence of cleaning failure between a cleaning opposed roller made of solid rubber and a cleaning opposed roller made of metal, which are incorporated in the transfer device depicted in FIG. 1;

FIG. 7 is a lookup table illustrating a fourth example according to a first embodiment of results concerning occurrence of cleaning failure under condition A of the transfer device depicted in FIG. 1;

FIG. 8 is a lookup table illustrating a fifth example according to the first embodiment of results concerning occurrence of cleaning failure under condition B of the transfer device depicted in FIG. 1;

FIG. 9 is a lookup table illustrating a sixth example according to the first embodiment of results concerning occurrence of cleaning failure under condition C of the transfer device depicted in FIG. 1;

FIG. 10 is a lookup table illustrating a seventh example according to the first embodiment of results concerning occurrence of cleaning failure under condition D of the transfer device depicted in FIG. 1;

FIG. 11 is a graph illustrating conditions in which no cleaning failure occurs in the fourth example, the fifth example, the sixth example, and the seventh example;

FIG. 12 is a lookup table illustrating a comparison relating to occurrence of cleaning failure between the cleaning opposed roller made of metal and disposed opposite a scraper incorporated in the transfer device depicted in FIG. 1 as an eighth example and the cleaning opposed roller not disposed opposite the scraper;

FIG. 13 is an enlarged schematic cross-sectional view of the transfer device depicted in FIG. 1, illustrating a vicinity of the cleaning; opposed roller;

FIG. 14 is a lookup table illustrating a ninth example according to a second embodiment of results concerning occurrence of cleaning failure under condition E of the transfer device depicted in FIG. 1;

FIG. 15 is a lookup table illustrating a tenth example according to the second embodiment of results concerning occurrence of cleaning failure under condition F of the transfer device depicted in FIG. 1;

FIG. 16 is a lookup table illustrating an eleventh example according to the second embodiment of results concerning occurrence of cleaning failure under condition G of the transfer device depicted in FIG. 1;

FIG. 17 is a lookup table illustrating a twelfth example according to the second embodiment of results concerning occurrence of cleaning failure under condition H of the transfer device depicted in FIG. 1;

Figure 1:
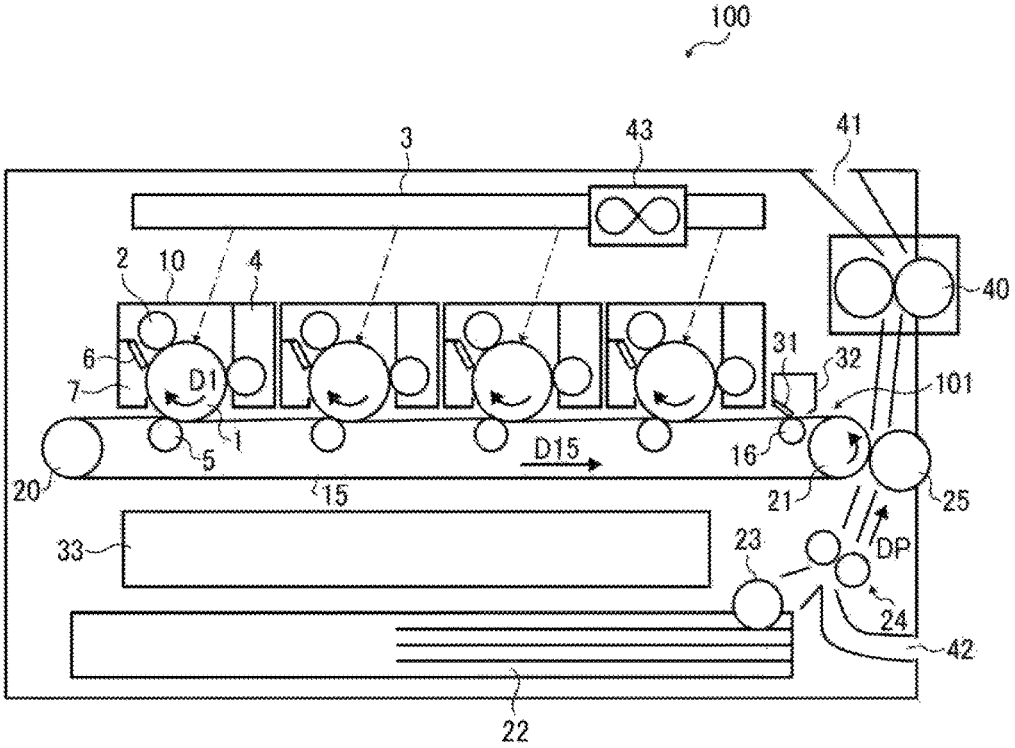
FIG. 1 is a schematic vertical cross-sectional view of an image forming apparatus according to an embodiment of the present disclosure, illustrating a transfer device incorporated therein.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

The image forming apparatus 100 may be a copier; a facsimile machine, a printer; a multifunction peripheral or a multifunction printer (MFP) having at least one of copying, printing, scanning, facsimile, and plotter functions, or the like. According to this embodiment, the image forming apparatus 100 is a color printer that forms a color toner image on a recording medium by electrophotography. Alternatively, the image forming apparatus 100 may be a monochrome printer that forms a monochrome toner image on a recording medium.

FIG. 1 is a schematic vertical cross-sectional view of the image forming apparatus 100 in its entirety. The image forming apparatus 100 includes a photoconductor 1 (e.g., a photoconductive drum) that is a tube having a diameter of 30 mm and is rotatable at a circumferential speed in a range of from 50 mm/s to 200 mm/s. A charger 2 is a roller pressed against an outer circumferential surface of the photoconductor 1. As the photoconductor 1 rotates clockwise in FIG. 1 in a rotation direction D1, the charger 2 rotates in accordance with rotation of the photoconductor 1. A high voltage power supply disposed inside the image forming apparatus 100 applies a bias produced by a direct current (DC) or an alternating current (AC) superimposed on the direct current to the charger 2, thus uniformly charging the outer circumferential surface of the photoconductor 1 at a surface potential of −500V or the like.

Subsequently, an exposure device 3 serving as a latent image writer exposes the photoconductor 1 according to image data, forming an electrostatic latent image on the photoconductor 1 in an exposure process. For example, the exposure device 3 includes a laser beam scanner using a laser diode or a light-emitting diode (LED) that performs the exposure process. The surface potential of an exposed portion of the photoconductor 1 decreases to −50V or the like.

A developing device 4 is a one-component contact developing device that contacts the photoconductor 1 to develop the electrostatic latent image with a one-component developer (e.g., toner) into a toner image. The high voltage power supply disposed inside the image forming apparatus 100 supplies a predetermined developing bias of −200V or the like to the developing device 4, rendering the developing device 4 to visualize the electrostatic latent image formed on the photoconductor 1 as the toner image in a developing process. The developing device 4 stores the one-component developer (e.g., toner) charged with a negative polarity.

The photoconductor 1, the charger 2, the developing device 4, and a cleaner 7 are united into a process unit 10. The photoconductor 1 contacts an intermediate transfer belt 15 to form a primary transfer nip therebetween.

Four process units 10 are aligned in parallel. Visible images, that is, yellow, magenta, cyan, and black toner images, are formed on the photoconductors 1 in this order in a print job to form a full color toner image on a transfer sheet. The yellow, magenta, cyan, and black toner images formed on the photoconductors 1 are primarily transferred onto the intermediate transfer belt 15 serving as a belt type image bearer successively such that the yellow, magenta, cyan, and black toner images are superimposed on a same position on the intermediate transfer belt 15. Thus, a full color toner image is formed on the intermediate transfer belt 15 in a primary transfer process.

The cleaner 7 includes a cleaning blade 6 that contacts the photoconductor 1 counter to the rotation direction D1 of the photoconductor 1. In a cleaning process, the cleaning blade 6 scrapes residual toner failed to be transferred onto the intermediate transfer belt 15 and therefore remaining on the photoconductor 1 after the primary transfer process, thus cleaning the photoconductor 1.

A secondary transfer roller 25 is pressed against a driving roller 21 via the intermediate transfer belt 15 to form a secondary transfer nip between the secondary transfer roller 25 and the intermediate transfer belt 15. At the secondary transfer nip, the secondary transfer roller 25 secondarily transfers the full color toner image formed on the intermediate transfer belt 15 onto a transfer sheet serving as a recording medium in a secondary transfer process.

The intermediate transfer belt 15 is stretched taut across the driving roller 21, a cleaning opposed roller 16, four primary transfer rollers 5, and a tension roller 20. A driver (e.g., a motor) disposed inside the image forming apparatus 100 drives and rotates the driving roller 21 which drives and rotates the intermediate transfer belt 15. A driver that drives the process unit 10 may be identical to or different from a driver that drives the driving roller 21. However, at least the process unit 10 that forms the black toner image and the driving roller 21 are turned on and off simultaneously. Accordingly, the driver that drives the process unit 10 is preferably identical to the driver that drives the driving roller 21 to downsize the image forming apparatus 100 and manufacture the image forming apparatus 100 at reduced costs. Springs serving as biasing members bias the tension roller 20 against the intermediate transfer belt 15 at both lateral ends of the tension roller 20 in an axial direction thereof.

An intermediate transfer belt cleaning unit 32 includes a cleaning blade 31. The cleaning blade 31 contacts the intermediate transfer belt 15 counter to a rotation direction D15 of the intermediate transfer belt 15. The cleaning blade 31 scrapes residual toner failed to be transferred onto the transfer sheet and therefore remaining on the intermediate transfer belt 15 therefrom, thus cleaning the intermediate transfer belt 15. Alternatively, the image forming apparatus 100 may be installed with a cleaning unit employing an electrostatic brush system, an electrostatic roller system, or the like instead of a cleaning blade system. If the image forming apparatus 100 employs the electrostatic brush system or the electrostatic roller system, instead of the cleaning blade 31, a cleaning brush or a cleaning roller applied with a bias is disposed opposite the intermediate transfer belt 15. The cleaning brush or the cleaning roller may require preliminary charging of the residual toner according to a usage of the image forming apparatus 100. Accordingly, the intermediate transfer belt cleaning unit 32 may be upsized one or two systems of a high voltage power supply may be added, and an extra process to eliminate a bias may be conducted disadvantageously. To address those circumstances, the cleaning blade method is preferably employed to downsize the image forming apparatus 100, manufacture the image forming apparatus 100 at reduced costs, and improve cleaning.

The residual toner scraped off the intermediate transfer belt 15 by the cleaning blade 31 is conveyed into a waste toner container 33 through a toner conveyance tube disposed inside the image forming apparatus 100. The residual toner scraped off the photoconductor 1 by the cleaning blade 6 may also be conveyed into the waste toner container 33.

The primary transfer roller 5 is a metallic roller having a diameter in a range of from 12 mm to 16 mm. The primary transfer roller 5 is disposed opposite the photoconductor 1 via the intermediate transfer belt 15. A single high voltage power supply disposed inside the image forming apparatus 100 applies a predetermined primary transfer bias in a range of from +100 V to +200 V to the primary transfer roller 5 to primarily transfer the toner image formed on the photoconductor 1 onto the intermediate transfer belt 15. The primary transfer roller 5 is an ion conductivity roller made of urethane and dispersed carbon, nitrile butadiene rubber (NBR), or hydrin rubber, an electronic conductivity roller made of ethylene-propylene-diene monomer (EPDM), a metallic roller; or the like, which are adjusted to have a resistance in a range of from $10^6\Omega$ to $10^8\Omega$. The image forming apparatus 100 may employ a direct transfer system in which the primary transfer roller 5 contacts the photoconductor 1 or an indirect transfer system in which the primary transfer roller 5 does not contact the photoconductor 1.

The intermediate transfer belt 15 is an endless belt or resin film made of polyvinylidene fluoride (PVDF) ethylene tetrafluoroethylene (ETFE), polyimide (PI), polycarbonate (PC), thermoplastic elastomer (TPE), or the like with a conductive material such as carbon black dispersed therein. According to this embodiment, the intermediate transfer belt 15 is a belt constructed of a plurality of layers made of TPE having a tensile modulus of elasticity in a range of from 1000 MPa to 2000 MPa and carbon black added to TPE. The belt has a thickness in a range of from 90 μm to 160 μm and a width of 230 mm. The intermediate transfer belt 15 has an electric resistance defined by a volume resistivity in a range of from $10^8$ Ω·cm to $10^{11}$ Ω·cm and a surface resistivity in a range of from $10^8$ Ω/□ to $10^{11}$ Ω/□ measured under an environment of a temperature of 23 degrees centigrade and a humidity of 50% RH with HirestaUP MCP-HT450 available from Mitsubishi Chemical Analytech, Co., Ltd. under a voltage of 500 V applied for 10 seconds.

The secondary transfer roller 25 is a sponge roller having a diameter in a range of from 16 mm to 25 mm. The secondary transfer roller 25 is an ion conductivity roller made of urethane and dispersed carbon, NBR, or hydrin rubber, an electronic conductivity roller made of EPDM, or the like, which is adjusted to have a resistance in a range of from $10^6\Omega$ to $10^8\Omega$.

If the resistance of the secondary transfer roller 25 exceeds the above-described range, an electric current may not flow smoothly. Accordingly, in order to secondarily transfer the toner image properly, a high voltage may be applied to the secondary transfer roller 25, increasing manufacturing costs of a power supply. The high voltage may generate discharge in intervals disposed upstream and downstream from the secondary transfer nip in a transfer sheet conveyance direction DP. The discharge may produce white spots or white voids where toner is partly absent on a halftone image on the transfer sheet. The white spots may appear frequently under an environment of a low temperature of 10 degrees centigrade and a low humidity of 15% RH, for example.

Conversely, if the resistance of the secondary transfer roller 25 is below the above-described range, the secondary transfer roller 25 may not secondarily transfer a multicolor toner image (e.g., a tricolor toner image) and a monochrome toner image in an identical toner image properly due to a reason below.

When the secondary transfer roller 25 secondarily transfers the monochrome image, the secondary transfer roller 25 is applied with an electric current sufficiently even under a relatively low voltage. Conversely, when the secondary transfer roller 25 transfers the multicolor toner image, the secondary transfer roller 25 requires a high voltage higher than an appropriate voltage for the monochrome toner image. Accordingly, if the secondary transfer roller 25 is configured to be supplied with the high voltage appropriate to transfer the multicolor toner image, the secondary transfer roller 25 may suffer from excessive supply of the electric current when the secondary transfer roller 25 transfers the monochrome toner image, thus degrading transfer efficiency.

The resistance of the primary transfer roller 5 and the secondary transfer roller 25 was measured by placing the secondary transfer roller 25 on a conductive metal plate, imposing a load of 4.9 N to each lateral end of a core bar of the secondary transfer roller 25, applying a voltage of 1 kV between the core bar and the metal plate, and measuring an electric current that flows under the voltage of 1 kV.

The driving roller 21 may be constructed of a polyurethane rubber layer having a thickness in a range of from 0.3 mm to 1 mm and a thin coating layer having a thickness in a range of from 0.03 mm to 0.1 mm, for example. According to this embodiment, the driving roller 21 is a roller having a diameter of 22 mm and including a urethane coating layer having a thickness of 0.05 mm, thus decreasing change in diameter due to temperature. The driving roller 21 has an electric resistance that is not greater than $10^6\Omega$ and lower than the electric resistance of the secondary transfer roller 25.

One or more transfer sheets are placed on a paper tray 22 or a bypass tray 42. A feed roller 23, a registration roller pair 24, and the like feed a transfer sheet to the secondary transfer nip at a time when a leading edge of the toner image on an outer circumferential surface of the intermediate transfer belt 15 reaches the secondary transfer nip. A high voltage power supply applies a predetermined secondary transfer bias to secondarily transfer the toner image formed on the intermediate transfer belt 15 onto the transfer sheet. According to this embodiment, the transfer sheet is conveyed vertically in FIG. 1. A curvature of the driving roller 21 separates the transfer sheet from the intermediate transfer belt 15. A fixing device 40 fixes the toner image on the transfer sheet. Thereafter, the transfer sheet bearing the fixed toner image is ejected through an outlet 41.

The secondary transfer bias is produced in two methods, that is, an attraction transfer method or a repulsive force transfer method. In the attraction transfer method, a positive bias is applied to the secondary transfer roller 25 and the driving roller 21 is grounded to create a secondary transfer electric field. In the repulsive force transfer method, a negative bias is applied to the driving roller 21 and the secondary transfer roller 25 is grounded to create a secondary transfer electric field. According to this embodiment, the attraction transfer method is employed and a positive electric current in a range of from +5 μA to +100 μA is applied under a constant current control as the secondary transfer bias while a transfer sheet is conveyed through the secondary transfer nip.

An image formation process speed varies depending on the type of the transfer sheet. For example, if the transfer sheet has a basis weight not smaller than 100 g/m$^2$, the image formation process speed is reduced by half to cause the transfer sheet to pass through a fixing nip formed between two rollers of the fixing device 40 for a passage time doubled compared to a passage time taken when the transfer sheet passes through the fixing nip at a normal image formation process speed, thus attaining a proper fixing performance to fix the toner image on the transfer sheet.

As illustrated in FIG. 1, since the developing, device 4 containing toner is situated immediately above the intermediate transfer belt 15, toner scattered from the developing device 4 accumulates on the outer circumferential surface of the intermediate transfer belt 15 easily. A fan 43 is disposed inside the image forming apparatus 100 or a transfer device 101 including the intermediate transfer belt 15 and the driving roller 21. The fan 43 blows air to cool an interior of the image forming apparatus 100 or the transfer device 101. The fan 43 creates an airflow from a rear to a front of the image forming apparatus 100 in a width direction or an axial direction of the intermediate transfer belt 15. Accordingly, as the intermediate transfer belt 15 rotates or the fan 43 produces the airflow, the toner scattered from the developing device 4 enters an interior of a loop formed by the intermediate transfer belt 15. If the toner adheres to the driving roller 21, adhesion between the driving roller 21 and the intermediate transfer belt 15 degrades, decreasing a coefficient of friction and a frictional force of the driving roller 21 and the intermediate transfer belt 15.

A description is provided of a construction of a comparative transfer device to address this circumstance.

A particle that is made of alumina or silicon carbide ceramics and has a diameter in a range of from 20 μm to 70 μm and a smaller circularity may be mixed with a coating of a driving roller to adjust the coefficient of friction of the driving roller. However, if friction between the driving roller and an intermediate transfer belt drops off the particle mixed with the coating from the coating, the dropped particle may adhere to an inner circumferential surface of the intermediate transfer belt and may enter a cleaning portion disposed opposite a metal roller, warping a cleaning blade and therefore causing cleaning failure.

A description is provided of a construction of another comparative transfer device.

In order to attain a sufficient coefficient of friction even when a transfer sheet conveyed by a driving roller is film that is susceptible to slippage, abrasion resistance particles each of which is made of alumina or silicon carbide ceramics and has a diameter in a range of from 20 μm to 70 μm and a small circularity are dispersed on the driving roller evenly. An abrasion resistance layer coats the driving roller and supports the abrasion resistance particles rigidly such that a part of the abrasion resistance particles is exposed radially from the driving roller.

However, if friction between the driving roller and an intermediate transfer belt drops off the abrasion resistance particles mixed with the coating from the coating, the dropped abrasion resistance particles may cause cleaning failure.

To address those circumstances, according to embodiments described below, the driving roller 21 includes a surface coating layer containing fine particles that adjust friction between the driving roller 21 and the intermediate transfer belt 15. The fine particles increase the coefficient of friction and the frictional force of the driving roller 21, preventing the toner entering the interior of the loop formed by the intermediate transfer belt 15 from decreasing the coefficient of friction and the frictional force of the driving roller 21.

Figure 2:
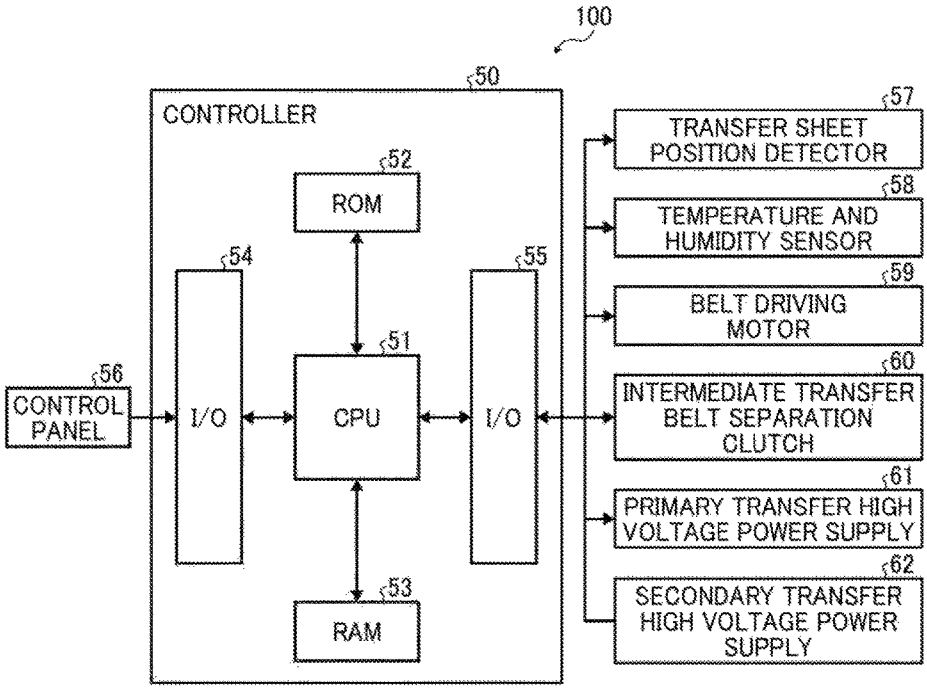
FIG. 2 is a block diagram of a control system of he image forming apparatus depicted in FIG. 1.

FIG. 2 is a block diagram of a control system of the image forming apparatus 100. As illustrated in FIG. 2, the image forming apparatus 100 includes a controller 50 including a central processing unit (CPU) 51, a memory constructed of a read only memory (ROM) 52 and a random access memory (RAM) 53, and input-output (I/O) ports 54 and 55 used for input and output of data. One part, that is, the I/O part 54, is coupled to a control panel 56 with which a user operates the image farming apparatus 100. Another port, that is, the I/O port 55, is coupled to a transfer sheet position detector 57, a temperature and humidity sensor 58, a belt driving motor 59, an intermediate transfer belt separation clutch 60, a primary transfer high voltage power supply 61, and a secondary transfer high voltage power supply 62. The transfer sheet position detector 57 calculates the position of the transfer sheet when the registration roller pair 24 depicted in FIG. 1 starts rotation to convey the transfer sheet to the secondary transfer nip. The temperature and humidity sensor 58 obtains environmental information such as the temperature and the humidity. The intermediate transfer belt separation clutch 60 separates the photoconductors 1 used to form yellow, magenta, and cyan toner images from the intermediate transfer belt 15 when the image forming apparatus 100 performs a print job to form a black toner image by using the photoconductor 1 used to form the black toner image.

Figure 3:
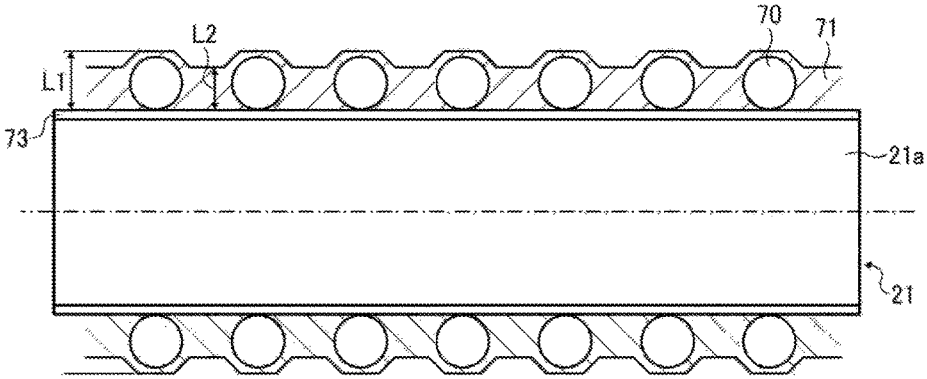
FIG. 3 is a schematic cross-sectional view of a driving roller including a coating layer and fine particles, which is incorporated in the transfer device depicted in FIG. 1.

FIG. 3 is a schematic cross-sectional view of the driving roller 21 including a coating layer 71 and fine particles 70 for adjusting friction between the driving roller 21 and the intermediate transfer belt 15.

As illustrated in FIG. 3, the driving roller 21 includes a core bar 21*a*, a base layer 73 layered on an outer circumferential surface of the core bar 21*a*, and the coating layer 71 being layered on the base layer 73 and containing the fine particles 70 to adjust friction between the driving roller 21 and the intermediate transfer belt 15. The fine particles 70 are distributed uniformly on the base layer 73. A length L1 from an outer circumferential surface of the base layer 73 to an outer circumferential surface of the coating layer 71 at a position where the fine particle 70 is situated in the coating layer 71 is greater than a length L2 from the outer circumferential surface of the base layer 73 to the outer circumferential surface of the coating layer 71 at a position where the fine particle 70 is not situated in the coating layer 71 in a direction perpendicular to an axial direction of the driving roller 21. Accordingly, the outer circumferential surface of the coating layer 71 has appropriate projections and recesses, thus being uneven in the axial direction of the driving roller 21 and increasing the frictional force exerted from the driving roller 21 to the intermediate transfer belt 15.

A description is provided of one example of a method for manufacturing the driving roller 21 illustrated in FIG. 3.

A liquid containing aluminum or urethane, for example, is sprayed onto the core bar 21*a* of the driving roller 21 directly. The base layer 73 is dried and stiffened. Abase liquid mixed with the fine particles 70 is sprayed onto the base layer 73. The base liquid is dried and stiffened to produce the coating layer 71 containing the fine particles 70 dispersed therein uniformly. Since the base layer 73 is produced prior to the coating layer 71, the coating layer 71 containing the fine particles 70 adheres to the driving roller 21 fixedly, thus being immune from peeling off. The fine particle 70 is made of resin or ceramics. The core bar 21*a* of the driving roller 21 is made of aluminum, for example.

FIG. 4 is a lookup table illustrating a comparison relating to occurrence of displacement of toner images formed on the intermediate transfer belt 15 between the driving roller 21 including the coating layer 71 containing the fine particles 70 for adjusting friction between the driving roller 21 and the intermediate transfer belt 15 and a comparative driving roller including a coating layer not containing fine particles.

Displacement of the toner images on the intermediate transfer belt 15 was checked as described below. After 1000 sheets of RICOH MY PAPER were printed with a chart having an image area rate of 5%, 10 sheets were printed with an L-shaped chart for checking displacement of the toner images on the intermediate transfer belt 15. In the L-shaped chart, four letters L were printed in yellow, magenta, cyan, and black such that corners of the four letters L abut on each other. Since the corners of the four letters L abut on each other, if displacement of the toner images on the intermediate transfer belt 15 occurs such displacement is identified readily. Displacement between the letters L was checked mechanically and visually by scanning the print sheets with a preliminary prepared jig. If displacement between the letters L was not greater than an allowable value, it was determined that no displacement occurred. According to the embodiments of the present disclosure, displacement denotes color shift in which the yellow, magenta, cyan, and black toner images firmed on the intermediate transfer belt 15 are shifted from each other.

A description is provided of a first example of the driving roller 21

The driving roller 21 incorporating the coating layer 71 containing the fine particles 70 caused no displacement of the toner images on the intermediate transfer belt 15, which might cause color shift of the yellow, magenta, cyan, and black toner images formed on the intermediate transfer belt 15.

A description is provided of a first comparative example of a comparative driving roller.

The comparative driving roller incorporating a comparative coating layer not containing fine particles caused displacement of the toner images on the intermediate transfer belt 15, which might cause color shift of the yellow, magenta, cyan, and black toner images formed on the intermediate transfer belt 15.

As described above, as illustrated in FIG. 1, the transfer device 101 includes the intermediate transfer belt 15 serving as a belt rotatable in the rotation direction D15 or an image bearer that bears a toner image and the driving roller 21 serving as a driving rotator that drives and rotates the intermediate transfer belt 15. The toner image formed on the intermediate transfer belt 15 is transferred onto a transfer sheet serving as a sheet type conveyed object at a transfer nip (e.g., the secondary transfer nip) defined by the intermediate transfer belt 15. The driving roller 21 includes the coating layer 71 as a surface layer that contains the fine particles 70. Accordingly, even if toner of the toner image scatters and adheres to the driving roller 21, since the coating layer 71 suppresses change in the coefficient of friction of the driving roller 21, the driving roller 21 drives the intermediate transfer belt 15 precisely and stably over time. Additionally, since the driving roller 21 drives the intermediate transfer belt 15 stably, the driving roller 21 prevents displacement of the toner images on the intermediate transfer belt 15. Thus, the driving roller 21 prevents color shift of the yellow, magenta, cyan, and black toner images from each other. The sheet type conveyed object includes paper, coated paper, thick paper, an overhead projector (OHP) transparency, plastic film, pre-preg, and copper foil.

FIG. 5 is a lookup table illustrating occurrence of cleaning failure according to change in the average particle diameter of the fine particle 70 contained in the coating layer 71. In FIG. 5, X represents the thickness (e.g., the layer thickness) of the coating layer 71. Occurrence of cleaning failure was examined and compared between a case in which the average particle diameter of the fine particle 70 was not smaller than X/2 and was smaller than X and a case in which the average particle diameter of the fine particle 70 was greater than 0 and smaller than X/2.

Cleaning failure was checked as described below. After 1000 sheets of RICOH MY PAPER were printed with a chart having an image area rate of 5%, 3 sheets of RICOH MY PAPER of A4 size for each of yellow, magenta, cyan, and black were printed such that each sheet bore a solid toner image having an image area rate of 100%. Thereafter, 5 blank sheets were output without forming a toner image on the blank sheets and appearance of a toner image on the blank sheets was checked. The blank sheets were checked visually to identify occurrence of cleaning failure. If any one of the blank sheets bore a toner image, cleaning failure had occurred. The average particle diameter was calculated as a volume average particle diameter Dv as described below.

A description is provided of a second example of the driving roller 21.

As illustrated in FIG. 5, in the case in which the average particle diameter of the fine particle 70 was not smaller than X/2 and was smaller than X, the driving roller 21 incorporating the coating layer 71 containing the fine particles 70 caused no cleaning failure. The fine particle 70 having the average particle diameter defined as being not smaller than X/2 and being smaller than X does not peel off the coating layer 71 easily.

A description is provided of a second comparative example of the comparative driving roller.

Conversely, in the case in which the average particle diameter of the fine particle 70 was greater than 0 and smaller than X/2, the driving roller 21 incorporating the coating layer 71 containing the fine particles 70 caused cleaning failure.

As described above, as illustrated in FIG. 1, the transfer device 101 includes the cleaning blade 31 serving as a cleaner that cleans the intermediate transfer belt 15 and the cleaning opposed roller 16 serving as an opposed rotator that is disposed opposite the cleaning blade 31 and in contact with an inner circumferential surface of the intermediate transfer belt 15. As illustrated in FIG. 3, the driving roller 21 includes the coating layer 71 as a surface layer that contains the fine particles 70. When X represents the thickness of the coating layer 71, the average particle diameter of the fine particle 70 was not smaller than X/2 and was smaller than X. Accordingly, even if the intermediate transfer belt 15 is driven for a substantial time, the fine particles 70 barely peel off the coating layer 71. Accordingly, the driving roller 21 prevents the fine particles 70 from peeling off the coating layer 71, adhering to the inner circumferential surface of the intermediate transfer belt 15, and entering a gap between the intermediate transfer belt 15 and the cleaning opposed roller 16. Consequently, the cleaning blade 31 removes toner from the outer circumferential surface of the intermediate transfer belt 15, suppressing cleaning failure.

FIG. 6 is a lookup table illustrating a comparison relating to occurrence of cleaning failure between the cleaning opposed roller 16 made of solid rubber and the cleaning opposed roller 16 made of metal.

Cleaning failure was checked as described below. After 1000 sheets of RICOH MY PAPER were printed with a chart having an image area rate of 5%, 3 sheets of RICOH MY PAPER of A4 size for each of yellow, magenta, cyan, and black were printed such that each sheet bore a solid toner image having an image area rate of 100%. Thereafter, 5 blank sheets were output without forming a toner image on the blank sheets and appearance of a toner image on the blank sheets was checked. The blank sheets were checked visually to identify occurrence of cleaning failure. If any one of the blank sheets bore a toner image, cleaning failure had occurred.

A description is provided of a third example of the cleaning opposed roller 16.

The cleaning opposed roller 16 made of solid rubber caused no cleaning failure.

A description is provided of a third comparative example of the cleaning opposed roller 16.

The cleaning opposed roller 16 made of metal caused cleaning failure.

As described above, the transfer device 101 includes the cleaning opposed roller 16 made of solid rubber. Accordingly, even if the fine particles 70 enter the gap between the intermediate transfer belt 15 and the cleaning opposed roller 16, the fine particles 70 are buried in a rubber layer of the cleaning opposed roller 16. Hence, the fine particles 70 do not protrude beyond an outer circumferential surface of the cleaning opposed roller 16 easily, suppressing cleaning failure precisely. Conversely, if the cleaning opposed roller 16 is made of metal, the fine particles 70 protrude beyond the outer circumferential surface of the cleaning opposed roller 16, causing cleaning failure.

FIGS. 7 to 10 illustrate occurrence of cleaning failure with the transfer device 101 according to a first embodiment. FIGS. 7 to 10 are lookup tables illustrating a relation concerning occurrence of cleaning failure between the average particle diameter and the circularity of the fine particle 70 under various conditions. FIG. 11 is a graph illustrating a relation concerning occurrence of cleaning failure between the average particle diameter and the circularity of the fine particle 70.

In addition to the driving roller 21 incorporating the coating layer 71 mixed with the fine particles 70 to adjust friction between the driving roller 21 and the intermediate transfer belt 15, the transfer device 101 further includes the cleaning opposed roller 16 made of rubber. Occurrence of cleaning failure was checked under tension and the Young's modulus of the intermediate transfer belt 1 that vary.

Cleaning failure was checked as described below under various conditions illustrated in FIGS. 7 to 10. After 1000 sheets of RICOH MY PAPER were printed with a chart having an image area rate of 5%, 3 sheets of RICOH MY PAPER of A4 size for each of yellow, magenta, cyan, and black were printed such that each sheet bore a solid toner image having an image area rate of 100%. Thereafter, 5 blank sheets were output without forming a toner image on the blank sheets and appearance of a toner image on the blank sheets was checked. The blank sheets were checked visually to identify occurrence of cleaning failure. If any one of the blank sheets bore a toner image, cleaning failure had occurred. In FIGS. 7 to 10, YES denotes occurrence of cleaning failure and NO denotes no occurrence of cleaning failure.

A description is provided of a fourth example of the driving roller 21 and the cleaning opposed roller 16 made of rubber.

FIG. 7 illustrates results concerning occurrence of cleaning failure under condition A of the transfer device 101 according to the fourth example in which the cleaning opposed roller 16 is made of rubber and the intermediate transfer belt 15 is applied with a tension of 135 N/m and has a Young's modulus as an elastic modulus of 1500 MPa. The fine particle 70 has an average particle diameter in a range of from 10 μm to 120 μm and a circularity in a range of from 0.75 to 0.95. No cleaning failure occurred under conditions marked NO in FIG. 7. For example, with the circularity in a range of from 0.9 to 0.95, regardless of the average particle diameter of the fine particle 70, substantially favorable results that caused no cleaning failure were obtained. Similarly, with the average particle diameter in a range of from 10 μm to 60 μm, regardless of the circularity of the fine particle 70, substantially favorable results that caused no cleaning failure were obtained. Overall, the fourth example achieved the most favorable results.

A description is provided of a fifth example of the driving roller 21 and the cleaning opposed roller 16 made of rubber.

FIG. 8 illustrates results concerning occurrence of cleaning failure under condition B of the transfer device 101 according to the fifth example in which the cleaning opposed roller 16 is made of rubber and the intermediate transfer belt 15 is applied with a tension of 155 N/m and has a Young's modulus as an elastic modulus of 1500 MPa. The fine particle 70 has an average, particle diameter in a range of from 10 μm to 120 μm and a circularity in a range of from 0.75 to 0.95. With the circularity in a range of from 0.9 to 0.95 and the average particle diameter in a range of from 10 μm to 80 μm, favorable results that caused no cleaning failure were obtained. With the average particle diameter in a range of from 10 μm to 40 μm, regardless of the circularity of the fine particle 70, substantially favorable results that caused no cleaning failure were obtained.

A comparison between the results illustrated in FIG. 7 and the results illustrated in FIG. 8 indicates that as the tension of the intermediate transfer belt 15 increases, cleaning failure is likely to occur due to reasons below. If the tension of the intermediate transfer belt 15 increases, when the fine particles 70 separated from the driving roller 21 enter the gap between the inner circumferential surface of the intermediate transfer belt 15 and the outer circumferential surface of the cleaning opposed roller 16, the fine particles 70 adhere to the intermediate transfer belt 15 more tightly, increasing undulation of the intermediate transfer belt 15 and disturbing cleaning by the cleaning blade 31.

A description is provided of a sixth example of the driving roller 21 and the cleaning opposed roller 16 made of rubber.

FIG. 9 illustrates results concerning occurrence of cleaning failure under condition C of the transfer device 101 according, to the sixth example in which the cleaning opposed roller 16 is made of rubber and the intermediate transfer belt 15 is applied with a tension of 135 N/m and has a Young's modulus as an elastic modulus of 3000 MPa. The fine particle 70 has an average particle diameter in a range of from 10 μm to 120 μm and a circularity in a range of from 0.75 to 0.95. With the circularity in a range of from 0.9 to 0.95 and the average particle diameter in a range of from 10 μm to 100 μm, substantially favorable results that caused no cleaning failure were obtained. With the average particle diameter in a range of from 10 μm to 40 μm, regardless of the circularity of the fine particle 70, substantially favorable results that caused no cleaning failure were obtained.

A comparison between the results illustrated in FIG. 7 and the results illustrated in FIG. 9 indicates that as the Young's modulus of the intermediate transfer belt 15 increases, cleaning failure is likely to occur. Similarly to the tension of the intermediate transfer belt 15, if the Young's modulus of the intermediate transfer belt 15 increases, the fine particles 70 adhere to the intermediate transfer belt 15 more tightly, increasing undulation of the intermediate transfer belt 15 and disturbing cleaning by the cleaning blade 31.

A description is provided of a seventh example of the driving roller 21 and the cleaning opposed roller 16 made of rubber.

FIG. 10 illustrates results concerning occurrence of cleaning failure under condition D of the transfer device 101 according to the seventh example in which the cleaning opposed roller 16 is made of rubber and the intermediate transfer belt 15 is applied with a tension of 155 N/m and has a Young's modulus as an elastic modulus of 3000 MPa. The fine particle 70 has an average particle diameter in a range of front 10 μm to 120 μm and a circularity in a range of from 0.75 to 0.95. With the circularity in a range of from 0.85 to 0.95 and the average particle diameter in a range of from 10 μm to 40 μm, substantially favorable results that caused no cleaning failure were obtained. With the average particle diameter of 10 μm, regardless of the circularity of the fine particle 70, substantially favorable results that caused no cleaning failure were obtained.

The results illustrated in FIGS. 7 to 10 indicate that the transfer device 101 preferably includes the tension roller 20 depicted in FIG. 1 serving as a biasing member that applies tension to the intermediate transfer belt 15. When the intermediate transfer belt 15 is applied with a tension in a range of from 135 N/m to 155 N/m and has a Young's modulus in a range of from 1500 MPa to 3000 MPa, the circularity of the fine particle 70 is preferably not smaller than 0.8. Thus, the circularity of the fine particle 70 is defined as described above, preventing cleaning failure.

FIG. 11 illustrates conditions in which no cleaning failure occurs in the fourth example, the fifth example, the sixth example, and the seventh example. A vertical axis y represents the average particle diameter in μm of the fine particle 70. A horizontal axis x represents the circularity of the fine particle 70. FIG. 11 substantially corresponds to FIG. 10. FIG. 11 illustrates a line defined by an approximation formula (1).

$$y=220x-165 \quad (1)$$

Accordingly, a condition in which no cleaning failure occurs is defined by a formula (2).

$$y<220x-165 \quad (2)$$

However, a formula (3) is involved.

$$x>0.75 \quad (3)$$

As illustrated in FIG. 11, when y represents the average particle diameter of the fine particle 70 and x represents the circularity of the fine particle 70, the formulas (2) and (3) are preferably satisfied. Thus, the average particle diameter of the line particle 70, in addition to the circularity of the fine particle 70, is defined as described above, preventing cleaning failure more precisely.

FIG. 12 is a lookup table illustrating a comparison relating to occurrence of cleaning failure between the cleaning opposed roller 16 made of metal and disposed opposite a scraper 72 and the cleaning opposed roller 16 not disposed opposite the scraper 72. FIG. 13 is a cross-sectional view of the transfer device 101, illustrating the scraper 72.

Cleaning failure was checked as described below. After 1000 sheets of RICOH MY PAPER were printed with a chart having an image area rate of 5%, 3 sheets of RICOH MY PAPER of A4 size for each of yellow, magenta, cyan, and black were printed such that each sheet bore a solid toner image having an image area rate of 100%. Thereafter, 5 blank sheets were output without forming a toner image on the blank sheets and appearance of a toner image on the blank sheets was checked. The blank sheets were checked visually to identify occurrence of cleaning failure. If any one of the blank sheets bore a toner image, cleaning failure had occurred.

A description is provided of an eighth example of the cleaning opposed roller 16.

A configuration in which the scraper 72 is disposed opposite the cleaning opposed roller 16 caused no cleaning failure.

A description is provided of a fourth comparative example of the cleaning opposed roller 16.

A configuration in which the scraper 72 is not disposed opposite the cleaning opposed roller 16 caused cleaning failure.

FIG. 13 is an enlarged schematic cross-sectional view of the transfer device 101, illustrating a vicinity of the cleaning opposed roller 16.

As illustrated in FIG. 13, the scraper 72 contacts the outer circumferential surface of the cleaning opposed roller 16 made of metal counter to a rotation direction of the cleaning opposed roller 16. If the cleaning opposed roller 16 is made of metal, foreign substances such as the fine particles 70 separated from the driving roller 21, toner (e.g., toner particles), dust, and the like may adhere to the outer circumferential surface of the cleaning opposed roller 16. When the foreign substances adhered to the cleaning opposed roller 16 come to an opposed position where the foreign substances are disposed opposite the cleaning blade 31 via the intermediate transfer belt 15, the foreign substances may cause cleaning failure. The foreign substances adhered to the cleaning opposed roller 16 come to the opposed position periodically whenever the cleaning opposed roller 16 rotates for a circumferential length thereof of 30 mm, for example. Accordingly, cleaning failure may cause the transfer sheet to suffer from degradation in quality of the toner image transferred onto the transfer sheet, which appears per the circumferential length of the cleaning opposed roller 16. To address this circumstance, the scraper 72 scrapes the foreign substances off the cleaning opposed roller 16, thus suppressing cleaning failure.

As illustrated in FIGS. 12 and 13, the transfer device 101 includes the cleaning opposed roller 16 serving as a metallic roller and the scraper 72 that contacts the outer circumferential surface of the cleaning opposed roller 16. The metallic roller is manufactured at reduced costs. Even if the fine particles 70 adhere to the outer circumferential surface of the cleaning opposed roller 16 as the metallic roller, the scraper 72 scrapes the fine particles 70 off the cleaning opposed roller 16. Accordingly, the scraper 72 prevents the fine particles 70 from entering a gap between the cleaning blade 31 and the cleaning opposed roller 16 at the opposed position where the cleaning opposed roller 16 is disposed opposite the cleaning blade 31 via the intermediate transfer belt 15, thus suppressing cleaning failure.

Figure 18:
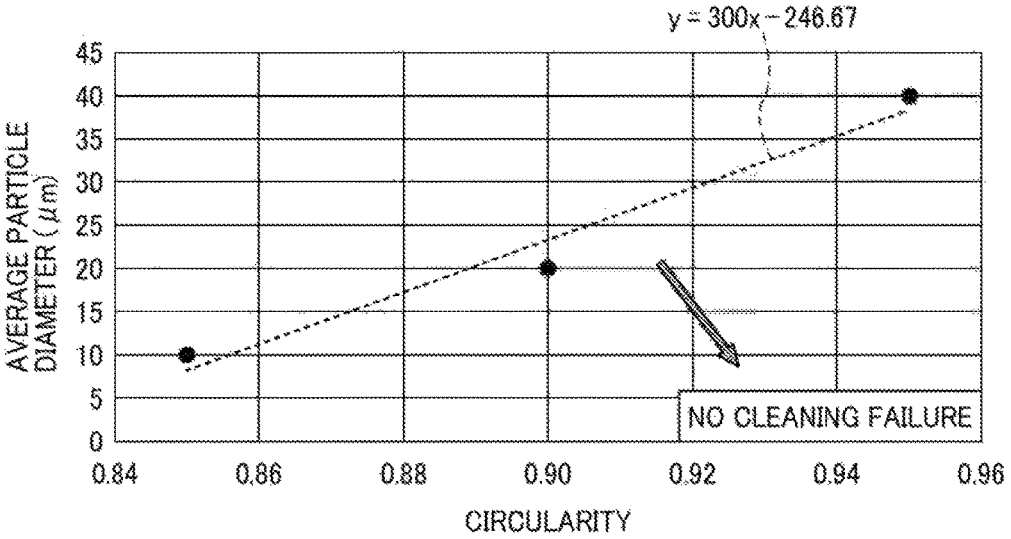
FIG. 18 is a graph illustrating conditions in which no cleaning failure occurs in the ninth example, the tenth example, the eleventh example, and the twelfth example.

FIGS. 14 to 18 illustrate occurrence of cleaning failure with the transfer device 101 according to a second embodiment. FIGS. 14 to 17 are lookup tables illustrating, a relation concerning, occurrence of cleaning failure between the average particle diameter and the circularity of the fine particle 70 under various conditions. FIG. 18 is a graph illustrating a relation concerning occurrence of cleaning; failure between the average particle diameter and the circularity of the fine particle 70.

In addition to the driving roller 21 incorporating the coating layer 71 mixed with the fine particles 70 to adjust friction between the driving roller 21 and the intermediate transfer belt 15, the transfer device 101 further includes the cleaning opposed roller 16 made of metal. Occurrence of cleaning failure was checked under tension and the Young's modulus of the intermediate transfer belt 15 that vary.

Cleaning failure was checked similarly to the first embodiment as described above to attain results illustrated in FIGS. 14 to 18.

A description is provided of a ninth example of the driving roller 21 and the cleaning opposed roller 16 made of metal.

FIG. 14 illustrates results concerning occurrence of cleaning failure under condition E of the transfer device 101 according to the ninth example in which the cleaning opposed roller 16 is made of metal and the intermediate transfer belt 15 is applied with a tension of 135 N/m and has a Young's modulus as an elastic modulus of 1500 MPa. The fine particle 70 has an average particle diameter in a range of from 10 μm to 120 μm and a circularity in a range of from 0.75 to 0.95. No cleaning failure occurred under conditions marked NO in FIG. 14. For example, with the average particle diameter in a range of from 10 μm to 40 μm, regardless of the circularity of the fine particle 70, substantially favorable results that caused no cleaning, failure were obtained. Similarly, with the circularity in a range of from 0.8 to 0.95 and the average particle diameter in a range of from 10 μm to 60 μm, substantially favorable results that caused no cleaning failure were obtained.

A description is provided of a tenth example of the driving roller 21 and the cleaning opposed roller 16 made of metal.

FIG. 15 illustrates results concerning occurrence of cleaning failure under condition F of the transfer device 101 according to the tenth example in which the cleaning opposed roller 16 is made of metal and the intermediate transfer belt 15 is applied with a tension of 155 N/m and has a Young's modulus as an elastic modulus of 1500 MPa. The fine particle 70 has an average particle diameter in a range of from 10 μm to 120 μm and a circularity in a range of from 0.75 to 0.95. With the circularity in a range of from 0.85 to 0.95 and the average particle diameter in a range of from 10 μm to 40 μm, substantially favorable results that caused no cleaning failure were obtained. With the average particle diameter of 10 μm, regardless of the circularity of the fine particle 70, substantially favorable results that caused no cleaning failure were obtained.

A description is provided of an eleventh example of the driving roller 21 and the cleaning opposed roller 16 made of metal.

FIG. 16 illustrates results concerning occurrence of cleaning failure under condition G of the transfer device 101 according to the eleventh example in which the cleaning opposed roller 16 is made of metal and the intermediate transfer belt 15 is applied with a tension of 155 N/m and has a Young's modulus as an elastic modulus of 3000 MPa. The fine particle 70 has an average particle diameter in a range of from 10 μm to 120 μm and a circularity in a range of from 0.75 to 0.95. With the circularity in a range of from 0.85 to 0.95 and the average particle diameter in a range of from 10 μm to 40 μm, substantially favorable results that caused no cleaning failure were obtained.

A description is provided of a twelfth example of the driving roller 21 and the cleaning opposed roller 16 made of metal.

FIG. 17 illustrates results concerning occurrence of cleaning failure under condition H of the transfer device 101 according, to the twelfth example in which the cleaning opposed roller 16 is made of metal and the intermediate transfer belt 15 is applied with a tension of 155 N/m and has a Young's modulus as an elastic modulus of 3000 MPa. The fine particle 70 has an average particle diameter in a range of from 10 μm to 120 μm and a circularity in a range of from 0.75 to 0.95. With the circularity in a range of from 0.9 to 0.95 and the average particle diameter in a range of from 10 μm to 40 μm, substantially favorable results that caused no cleaning failure were obtained. With the circularity in a range of from 0.85 to 0.95 and the average particle diameter in a range of from 10 μm to 20 μm, substantially favorable results that caused no cleaning failure were obtained.

The results illustrated in FIGS. 14 to 17 indicate that the transfer device 101 preferably includes the tension roller 20 serving as a biasing member that applies tension to the intermediate transfer belt 15. When the intermediate transfer belt 15 is applied with a tension in a range of from 135 N/m to 155 N/m and has a Young's modulus in a range of from 1500 MPa to 3000 MPa, the circularity of the fine particle 70 is preferably not smaller than 0.85. Thus, the circularity of the fine particle 70 is defined as described above, preventing cleaning failure.

FIG. 18 illustrates conditions in which no cleaning failure occurs in the ninth example, the tenth example, the eleventh example, and the twelfth example. A vertical axis y represents the average particle diameter in μm of the fine particle 70. A horizontal axis x represents the circularity of the fine particle 70. The average particle diameter was calculated as a volume average particle diameter described below. FIG. 18 substantially corresponds to FIG. 17. FIG. 18 illustrates a line defined by, an approximation formula (4).

$$y=300x-246.67 \quad (4)$$

Accordingly, a condition in which no cleaning failure occurs is defined by a formula (5).

$$y<300x-246.67 \quad (5)$$

However, a formula (b) is involved.

$$x\geq 0.83 \quad (6)$$

As illustrated in FIG. 18, when y represents the average particle diameter of the fine particle 70 and x represents the circularity of the fine particle 70, the formulas (5) and (6) are preferably satisfied. Thus, the average particle diameter of the fine particle 70, in addition to the circularity of the fine particle 70, is defined as described above, preventing cleaning failure more precisely.

Further, when the fine particle 70 was made of resin or ceramics, cleaning failure occurred. Cleaning failure was checked as described below. After 1000 sheets of RICOH MY PAPER were printed with a chart having an image area rate of 5%, 3 sheets of RICOH MY PAPER of A4 size for each of yellow, magenta, cyan, and black were printed such that each sheet bore a solid toner image having an image area rate of 100%. Thereafter, 5 blank sheets were output without forming a toner image on the blank sheets and appearance of a toner image on the blank sheets was checked. The blank sheets were checked visually to identify occurrence of cleaning failure.

Compared to the fine particle 70 made of ceramics, the fine particle 70 made of resin is not susceptible to peeling off from an outer circumferential surface of the driving roller 21 and cleaning failure. However, the fine particle 70 made of ceramics may be used by adjusting, conditions such as the material of the cleaning opposed roller 16, the tension and the Young's modulus of the intermediate transfer belt 15, and the average particle diameter and the circularity of the fine particle 70.

In the first example to the twelfth example, with the tension of the intermediate transfer belt 15 in a range of from 118 N/m to 155 N/m and the Young's modulus as an elastic modulus in a range of from 1300 MPa to 3000 MPa, according to the average particle diameter and the circularity of the fine particle 70, favorable results that caused no cleaning failure were obtained.

For example, the transfer device 101 installed in the image forming apparatus 100 preferably incorporates the fine particle 70 that has an average particle diameter not greater than 20 μm and a circularity not smaller than 0.85.

A description is provided of a measurement method for measuring the volume average particle diameter Dv.

The Beckman Coulter Multisizer™ 3 COULTER COUNTER® available from Beckman Coulter, Inc. was used as a measurement instrument to which an interface available from Nikkaki Bios Co., Ltd. which outputs a number distribution and a volume distribution and a personal computer are connected. As an electrolyte solution, an aqueous solution of sodium chloride having 1 weight percent was prepared in a beaker by using primary sodium chloride. A surfactant of alkylbenzene sultanate in an amount in a range of from 0.1 mL to 5 mL was added as a dispersant to an aqueous solution in an amount in a range of from 100 mL to 150 mL as an electrolytic solution. Fine particles in an amount in a range of from 2 mg to 20 mg were added and dispersed for 1 minute to 3 minutes with an ultrasonic disperser to prepare a sample dispersion liquid. Additionally, an electrolyte solution in an amount in a range of from 100 mL to 200 mL was added into another beaker. The sample dispersion liquid was added into the another beaker to attain a predetermined concentration. The Beckman Coulter Multisizer™ 3 COULTER COUNTER® measured the volume average particle diameter Dv of 50000 fine particles with a 100 μm aperture. The dispersion liquid of the fine particles was dropped such that the measurement instrument indicated a concentration of 8%±2%.

A description is provided of a measurement method for measuring the average circularity.

The average circularity was measured with a flow type particle image analyzer FPIA®-3000 available from Sysmex Corporation and analytical software FPIA-3000 Data Processing Program for FPIA version 00-10. For example, a surfactant of 10 weight percent (e.g., alkyl benzene sulfonate Neogen SC-A available from DKS Co. Ltd.) in an amount in a range of from 0.1 mL to 0.5 mL was added into a 100 mL glass beaker. Fine particles in an amount in a range of from 0.1 g to 0.5 g were added and stirred with a micro spatula. Subsequently, ion-exchange water in an amount of 80 mL was added to obtain a dispersion liquid. The dispersion liquid was dispersed for 3 minutes with an ultrasonic disperser available from Honda Electronics Co., Ltd. The shape and the distribution of the fine particles were measured with the analytical software FPIA-3000 until the concentration increases to a range of from 5000 pieces/μL to 15000 pieces/μL.

According to the embodiments described above, the driving roller 21 includes the coating layer 71 as a surface layer containing the fine particles 70. Accordingly, even if toner of the toner image scatters and adheres to the driving roller 21, since the coating layer 71 suppresses change in the coefficient of friction of the driving roller 21, the driving roller 21 drives the intermediate transfer belt 15 precisely and stably for an extended period of time.

The particle diameter and the circularity of the fine particle 70 used for adjustment of friction between the driving roller 21 and the intermediate transfer belt 15 and added to the coating layer 71 to coat the driving roller 21 are defined. Accordingly, even if the fine particle 70 is separated from the coating layer 71 by friction between the driving roller 21 and the intermediate transfer belt 15, the separated fine particle 70 adheres to the inner circumferential surface of the intermediate transfer belt 15, and the adhered fine particle 70 reaches the opposed position where the cleaning blade 31 contacts the intermediate transfer belt 15 to clean the intermediate transfer belt 15, the fine particle 70 does not warp the cleaning blade 31. Consequently, the fine particle 70 separated from the coating layer 71 does not cause cleaning failure, preventing cleaning failure.

The transfer device 101 according to the embodiments described above is installed in the image forming apparatus 100 that forms a color toner image by an intermediate transfer method in which the plurality of photoconductors 1 bears yellow, magenta, cyan, and black toner images on the outer circumferential surface of the respective photoconductors 1 and the yellow, magenta, cyan, and black toner images formed on the photoconductors 1, respectively, are transferred onto the intermediate transfer belt 15. Alternatively, the transfer device 101 may be installed in image forming apparatuses of other types. For example, the transfer device 101 may be installed in an image forming apparatus that forms a monochrome toner image in an intermediate transfer method in which a toner image formed on the single photoconductor 1 is transferred onto an intermediate transfer belt. In this case also, the transfer device 101 incorporates the driving roller 21 serving as a driving rotator that includes the coating layer 71 as a surface layer containing the fine particles 70. The driving roller 21 drives and rotates the intermediate transfer belt 15 precisely and stably, preventing displacement of the toner images when the toner image is transferred from the photoconductor 1 onto the intermediate transfer belt 15.

The present disclosure is also applicable to a transfer device employing a direct transfer method. For example, the transfer device includes a photoconductor that bears a toner image, a conveyance belt that conveys a conveyed object (e.g., a transfer sheet), and a driving roller that drives and rotates the conveyance belt. The toner image formed on the photoconductor is transferred onto the conveyed object at a transfer nip formed between the photoconductor and the conveyance belt. In this case also, the transfer device includes the driving roller 21 including the coating layer 71 containing the fine particles 70 as a surface layer. That is, the present disclosure is applicable to a transfer device using the direct transfer method in which the toner image is transferred directly onto the conveyed object (e.g., a transfer sheet) from the photoconductor.

Figure 19:
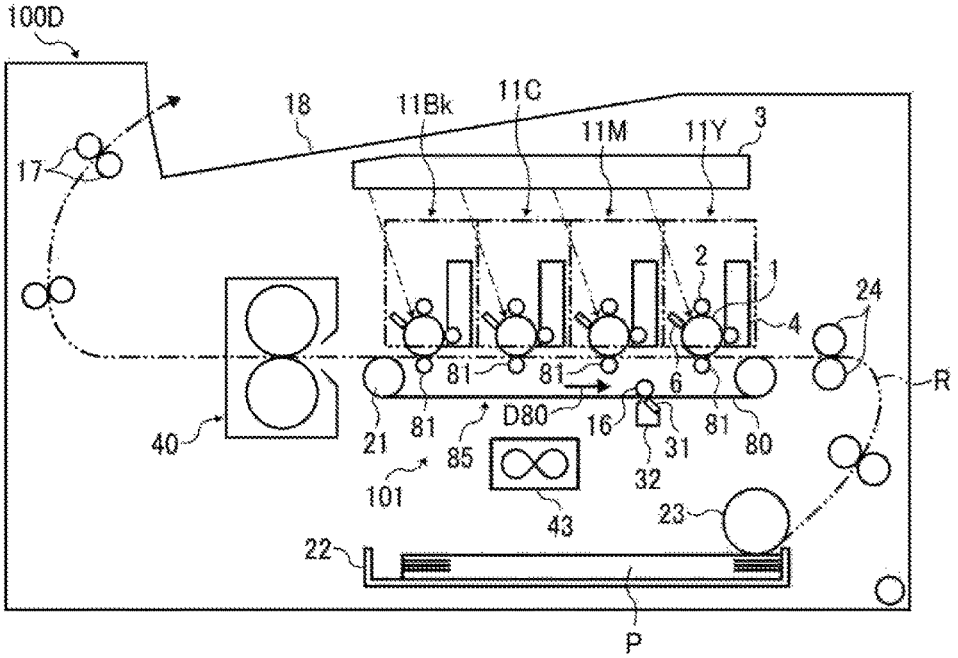
FIG. 19 is a schematic vertical cross-sectional view or another image forming apparatus according to an embodiment of the present disclosure.

FIG. 19 is a schematic vertical cross-sectional view of another image forming apparatus 100D.

The image forming apparatus 100D illustrated in FIG. 19 employs the direct transfer method in which a toner image formed on the photoconductor 1 is transferred onto a transfer sheet P directly. For example, as illustrated in FIG. 19, the image forming apparatus 100D includes a transfer device 85 that includes a conveyance belt 80 that is endless and rotatable in a rotation direction D80. The conveyance belt 80 is stretched taut across a plurality of rollers, that is, the driving roller 21, the cleaning opposed roller 16, and a plurality of primary transfer rollers 81. The conveyance belt 80 serves as a conveyor that conveys the transfer sheet P. The transfer sheet P is picked up from the paper tray 22 and fed by the feed roller 23. The transfer sheet P is conveyed to the conveyance belt 80 through a conveyance path R and the registration roller pair 24 that are disposed inside the image forming, apparatus 100D. As the conveyance belt 80 rotates, the transfer sheet P carried by the conveyance belt 80 is conveyed. The primary transfer rollers 81 transfer yellow, magenta, cyan, and black toner images formed on the photoconductors 1 by image forming devices 11Y, 11M, 11C, and respectively, onto the transfer sheet P on the conveyance belt 80 as a color toner image. The transfer sheet P bearing, the color toner image is conveyed to the fixing device 40. After the fixing device 40 fixes the color toner image on the transfer sheet P, an output roller pair 17 ejects the transfer sheet P onto an output tray 18.

In FIG. 19, other components of the image forming apparatus 100D which are assigned with the identical reference numerals depicted in FIG. 1 have the identical functions and therefore a description of those components of the image forming apparatus 100D is omitted.

Also in the image forming apparatus 100D, the photoconductor 1 and the developing device 4 are situated immediately above the conveyance belt 80. Accordingly, toner scattered from the photoconductor 1 and the developing device 4 accumulates on an outer circumferential surface of the conveyance belt 80 easily. The fan 43 is disposed inside the image forming apparatus 100D or the transfer device 101. The fan 43 blows air to cool an interior of the image forming apparatus 100D or the transfer device 101. The fan 43 creates an airflow from a rear to a front of the image forming apparatus 100D in a width direction or an axial direction of the conveyance belt 80. Accordingly, as the conveyance belt 80 rotates or the fan 43 creates the airflow, the toner scattered from the photoconductor 1 and the developing device 4 enter an interior of the conveyance belt 80. If the toner adheres to the driving roller 21, adhesion between the driving roller 21 and the conveyance belt 80 degrades, decreasing a coefficient of friction and a frictional force of the driving roller 21 and the conveyance belt 80.

To address this circumstance, according to the embodiments described above, the driving roller 21 includes, as a surface layer, the coating layer 71 containing the fine particles 70 that adjust friction between the driving roller 21 and the conveyance belt 80. The fine particles 70 increase the coefficient of friction and the frictional force of the driving roller 21, preventing the toner entering the interior of the conveyance belt 80 from decreasing the coefficient of friction and the frictional force of the driving roller 21. Accordingly, the conveyance belt 80 conveys a conveyed object (e.g., the transfer sheet P) stably. Consequently, the driving roller 21 prevents displacement (e.g., color shift) of yellow, magenta, cyan, and black toner images when the yellow, magenta, cyan, and black toner images are transferred from the photoconductors 1 onto the transfer sheet P on the conveyance belt 80.

A description is provided of advantages of the transfer device 101 also serving as a belt device.

As illustrated in FIGS. 1 and 19, a belt device or a transfer device (e.g., the transfer device 101) includes a belt (e g., the intermediate transfer belt 15 and the conveyance belt 80) that conveys a conveyed object (e.g., a transfer sheet P) and a driving rotator (e.g., the driving roller 21). The belt is rotatable. The belt may bear a toner image. The driving rotator drives and rotates the belt and is accidentally adhered with toner. A transferor (e.g. the secondary transfer roller 25 and the primary transfer roller 81) transfers the toner image onto the conveyed object that is sheet shaped and conveyed by the belt. As illustrated in FIG. 3, the driving rotator includes a coating layer (e.g., the coating layer 71) as a surface layer. The coating layer includes fine particles (e.g., the fine particles 70).

Accordingly, even if a foreign substance such as toner enters a gap between the driving rotator and the belt, the frictional force between the driving rotator and the belt does not decrease easily and the belt rotates precisely and stably.

Further, even if toner of the toner image scatters and adheres to the driving rotator, since the coating layer suppresses change in a coefficient of friction of the driving rotator, the driving rotator drives the belt precisely and stably over time. Additionally, since the driving rotator drives the belt stably, the driving rotator prevents displacement of the toner images transferred from the belt.

According to the embodiments described above, each of the intermediate transfer belt 15 and the conveyance belt 80 serves as a belt. Alternatively, a photoreceptor belt, a film, or the like may be used as a belt.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A belt device comprising:

a belt that is rotatable;

a driving rotator to drive and rotate the belt, and the driving rotator is exposed to a foreign substance that is adherable to a surface layer of the driving rotator;

a cleaner to clean the belt; and an opposed rotator being disposed opposite the cleaner and in contact with an inner circumferential surface of the belt, the driving rotator including a coating layer as the surface layer, the coating layer including a plurality of fine particles, and wherein the opposed rotator includes a roller made of solid rubber.

2. A transfer device comprising:

a belt that is rotatable;

a transferor, disposed opposite the belt, to transfer a toner image; and a driving rotator to drive and rotate the belt, and the driving rotator is exposed to toner that is adherable to a surface layer of the driving rotator, the driving rotator including a coating layer as the surface layer, the coating layer including a plurality of fine particles, an average particle diameter of the fine particles is not smaller than X/2 and is smaller than X, where X is a thickness of the coating layer, and a circularity of at least one of the fine particles is greater than 0.75.

3. The transfer device according to claim 2, wherein the belt conveys a sheet, and wherein the transferor includes a primary transfer roller to transfer the toner image onto the sheet conveyed by the belt.

4. The transfer device according to claim 2, wherein the belt bears the toner image, and wherein the transferor includes a secondary transfer roller to transfer the toner image from the belt onto a sheet.

5. The transfer device according to claim 2, further comprising:

a cleaner to clean the belt; and an opposed rotator being disposed opposite the cleaner and in contact with an inner circumferential surface of the belt.

6. The transfer device according to claim 5, wherein the opposed rotator includes a roller made of metal.

7. The transfer device according to claim 6, further comprising a scraper contacting an outer circumferential surface of the opposed rotator.

8. The transfer device according to claim 6, further comprising a biasing member to apply tension to the belt.

9. The transfer device according to claim 8, wherein when the belt is applied with a tension in a range of from 135 N/m to 155 N/m and has a Young's modulus in a range of from 1500 MPa to 3000 MPa, the circularity of the at least one of the fine particles is not smaller than 0.85.

10. The transfer device according to claim 8, wherein when x represents the circularity of the at least one of the fine particles and y represents the average particle diameter of the fine particles, x is not smaller than 0.83 and a following formula is satisfied:

$$y<300x-246.67.$$

11. The transfer device according to claim 2, wherein the fine particles are made of resin.

12. The transfer device according to claim 2, further comprising a fan to cool an interior of the transfer device, the fan to create an airflow in an axial direction of the belt.

13. The transfer device according to claim 2, wherein the driving rotator includes a driving roller.

14. The belt device according to claim 2, wherein a base layer to fixedly adhere the coating layer is interposed between a core bar of the driving rotator and the coating layer.

15. A transfer device comprising:

a belt that is rotatable;

a transferor, disposed opposite the belt, to transfer a toner image;

a driving rotator to drive and rotate the belt, and the driving rotator is exposed to toner that is adherable to a surface layer of the driving rotator;

a cleaner to clean the belt; and an opposed rotator being disposed opposite the cleaner and in contact with an inner circumferential surface of the belt, the driving rotator including a coating layer as the surface layer, the coating layer including a plurality of fine particles, and wherein the opposed rotator includes a roller made of solid rubber.

16. The transfer device according to claim 15, further comprising a biasing member to apply tension to the belt.

17. The transfer device according to claim 16, wherein the biasing member includes a tension roller.

18. The transfer device according to claim 16, wherein when the belt is applied with a tension in a range of from 135 N/m to 155 N/m and has a Young's modulus in a range of from 1500 MPa to 3000 MPa, a circularity of at least one of the fine particles is not smaller than 0.8.

19. The transfer device according to claim 16, wherein when x represents a circularity of at least one of the fine particles and y represents an average particle diameter of the fine particles, x is greater than 0.75 and a following formula is satisfied:

$$y<220x-165.$$

20. An image forming apparatus comprising:

a photoconductor to bear a toner image; and the transfer device according to claim 15 to transfer the toner image.

* * * * *